US006159535A

United States Patent [19]

Lutz et al.

[11] Patent Number: 6,159,535

[45] **Date of Patent: *Dec. 12, 2000**

[54] METHOD FOR APPLYING A PARTING AGENT ONTO AN INJECTION MOULD

[75] Inventors: Bernd Lutz, Uberlingen, Germany; Horst Adams, St. Gallen, Switzerland

[73] Assignee: Wagner International AG, Alstatten, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/204,738

[22] Filed: Dec. 2, 1998

[30] Foreign Application Priority Data

Dec. 3, 1997 [DE] Germany ..... 197 53 660

[51] Int. Cl.[7] ..... B05D 7/22

[52] U.S. Cl. ..... 427/133; 427/135; 427/181; 427/236; 427/421

[58] Field of Search ..... 427/421, 426, 427/133, 476, 135, 181, 236; 264/338, 328.1

[56] References Cited

U.S. PATENT DOCUMENTS

| | | | |
|---|---|---|---|
| 3,993,494 | 11/1976 | Nyman | 106/38.22 |
| 4,472,451 | 9/1984 | Mulder | 427/28 |
| 4,879,074 | 11/1989 | Waku et al. | 264/24 |
| 5,843,515 | 12/1998 | Crum et al. | 427/8 |

FOREIGN PATENT DOCUMENTS

| | | |
|---|---|---|
| 1796837 | 5/1959 | Germany . |
| 668934 | 2/1989 | Germany . |
| 4121455 A1 | 1/1993 | Germany . |

*Primary Examiner*—Shrive Beck
*Assistant Examiner*—Jennifer Calcagni
*Attorney, Agent, or Firm*—Fenwick & West LLP

[57] ABSTRACT

The invention discloses a method and a device for applying a parting agent onto an injection mould, by means of which a powdery parting agent can be applied in a gush-free manner by means of pressurized air. For this purpose, the feed air and the dosing air for the powdery parting agent are turned on, increased, reduced and turned off in a controlled manner by means of predetermined turn-on and turn-off profiles.

15 Claims, 2 Drawing Sheets

METHOD FOR APPLYING A PARTING AGENT ONTO AN INJECTION MOULD

The present invention refers to a method and an apparatus for applying a parting agent onto an injection mould.

Up to now liquids were regularly used as a parting agent for injection moulds. These agents were usually water/oil/grease emulsion-based agents. After opening the injection mould, the liquid parting agents are sprayed onto the mould half by means of a nozzle head by using very high pressurized air. This nozzle head is brought via a linear displacement unit between the mould halves. Since the mould halves are very hot after the opening process and at the beginning of spraying the liquid parting agent—in the range of some hundred degrees Celsius up to 700° C. and more, a large portion of the liquid parting agent evaporates before the temperature drops to such a degree that a layer is able to deposit on the surfaces of the mould halves, said layer facilitating the ejection of the injection moulded product from the injection mould in the next injection moulding cycle.

When spraying the liquid parting agent onto the hot injection mould, the largest portion of the parting agent sprayed evaporates and therefore gets lost. Since the amount of pressurized air necessary for spraying on the liquid parting agent is quite significant, the use of a liquid parting agent leads to a very high need of material. The evaporation of the liquid parting agent additionally generates a severe ecological damage due to the evaporating substances, such as solvents and the like.

When using liquid parting agents for the moulds of injection moulding machines, the problem occurs that the evaporation process restricts the rating of the injection moulding machine, since a new injection moulding part cannot be injected unless the injection mould has not cooled down to such an extent that a sufficient parting agent film can be sprayed on.

Thus, it is an object of the present invention to provide a method and a device for applying a parting agent onto an injection mould, which avoid the above described disadvantages and in particular require less pressurized air and parting agent and allow higher ratings of the injection moulding machine.

This object is solved by a method comprising the features of claim 1 and by a device comprising the features of claim 10.

According to the invention, a powdery parting agent instead of a liquid parting agent shall be sprayed onto the halves of the hot injection mould.

A method of applying a powdery lubricant onto an injection mould is basically known from the German utility model 1796837. This method is, however, not specified any closer regarding the adjustment of the powder-air mixture.

In the invention the powder is adjusted such that upon impinging onto the hot injection mould, which may for example have a surface temperature of 500° to 700° C., the powder immediately runs and forms a closed film on the surface of the injection mould halves without the ingredients of the powder being evaporated or burnt. The energy required for melting-on and linking the powdery parting agent is drawn off from the surfaces of the injection moulded parts thus cooling them.

The method and the device of applying this powdery parting agent may be derived from the powder coating technique, wherein, however, the particularities have to be taken account when spraying on the powdery parting agent.

First of all, the required powder quantities when spraying on the powdery parting agent onto the injection mould are clearly smaller than in the "normal" powder coating technique. In today's coating powder apparatus, powder ejection rates between 100 and 300 g/min per spray gun are common. In the present method and the apparatus for applying the parting agent onto the injection mould, an upper limit for the quantity of the powdery parting agent of 50 g/min per spray process is assumed. That means that the diameters of the supply line for the powdery parting agent and the diameter of the powder ducts in the spray means as well as the dimensions of the spray nozzle must be dimensioned such that on the one hand the maximum ejection quantity is restricted to for instance 50 g/min and on the other hand a favorable dosing ability exists which is in the range between 0 and 50 g/min and ensures a clear atomization at the spray nozzle. The feed device for feeding the powdery parting agent must be dimensioned for the lowest ejection rate.

The exact dimensioning of the lines and ducts, of the spray nozzle or the injector will significantly depend in each individual case on the respective apparatus (size of the injection moulds, distances to be covered etc.). The person skilled in the art of powder coating technique will, however, know which dimensions he has to chose for the different parts of the spray device in order to achieve the desired feed quantities and dosing accuracy. A guideline for the powder feed lines to the spray devices can be for instance a maximum inner diameter of the feed line of 10 mm.

A special control of the powder feed device by means of supply and dosing air is provided according to the invention. In order to achieve an optimum efficiency and a minimal delay, the powdery parting agent must be sprayed in a gush-free manner directly after opening the injection molds and directly after ejection of the moulded parts. In conventional spray apparatus, a more or less distinctive turn-on gush is generated when turning on the powder supply, since powder from the preceding spray process is still in the hose which is blown out in a gush when turning the apparatus on again.

In the method according to the invention, it is therefore operated with predetermined control profile when turning on and off the powder supply. Thus, it is for instance advantageous to turn off the feed air after each turn-off of the powder supply at the end of a spray shot and to control the dosing air to a higher or even maximum value. Thereby new powder is no longer taken in and the feed line is blown empty in a gush-free manner, wherein the powder cloud slowly fades. The powder cloud gradually becoming thinner may be utilized to apply the last touch of parting agent onto portions of the injection mould at which relatively few parting agent is to be applied.

When turning on the powder supply again for the next spray shot, the feed and dosing air are also increased according to special control commands in order to eject the powdery parting agent in a possibly gush-free manner at a predetermined quantity increase. The supply and dosing air are increased for this purpose for instance not abruptly, but gradually increasing in a ramp-like manner.

It is not useful to make inflexible definitions for the control profiles for feed and dosing air, such as certain ramp profiles, increase periods, turn-on and turn-off times, since these values depend on the respective installation and the special demands for the respective injection moulds.

In order to achieve an automatic operation of the above described processes and an even quality when applying the parting agent and in order to obtain a quality proof, the above described control functions are preferably not carried out by hand but they are automated. That means that an open-loop and closed-loop control is required to achieve the desired turn-on and turn-off profiles for the feed and dosing air and the desired dosing accuracy. This open-loop and closed-loop control shall preferably have an electronic memory to store control operations.

The method of the invention and the means have the important advantages of a 100% material yield of the powdery parting agent, since the parting agent applied onto the hot injection mould cross-links immediately and forms a film without the parting agent evaporating or burning, and causing a drastic reduction of the pressurized air consumption. The following values were found in a pilot test:

When injection moulding aluminum members at a consumption of 28,000 kg aluminum per day, pressurized air consumption of 900 $Nm^3/h$ was required when using liquid parting agents. When using powdery parting agents for the same amount of aluminum, 15 $Nm^3/h$ at a spray time of 5 seconds per spray shot was needed. Assuming pressurized air generation costs of 5 Pfennig per $Nm^3$, DM 138,000 will result when using liquid parting agent compared to pressurized air generation costs of DM 2,300 per year when using powdery parting agents. Moreover, a more favorable material yield can be achieved when using powdery parting agents and increase of the interval frequency of the injection moulding machine as well as a lower ecological damage.

BRIEF DESCRIPTION OF THE DRAWINGS

The invention will now be described by means of preferred embodiments with reference to the drawings.

DETAILED DESCRIPTION OF THE INVENTION

Figure 1:
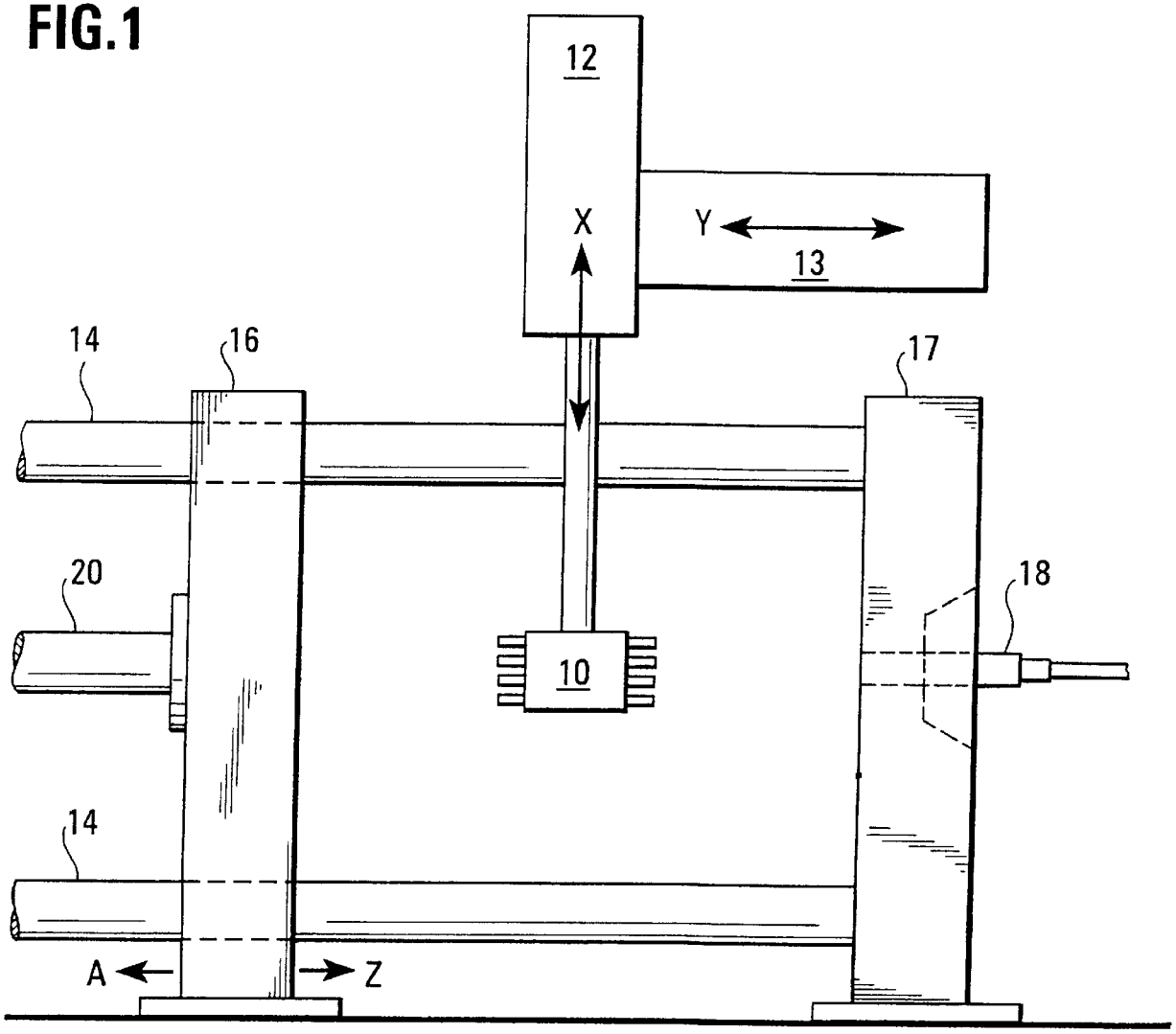
FIG. 1 is a schematical drawing of an apparatus of the invention for applying a powdery parting agent onto an injection mould, the injection mould being open.

FIG. 1 shows a general schematic view of an apparatus for applying a powdery parting agent onto an injection mould according to the invention. FIG. 1 shows a spray head 10, which includes eight spray guns or nozzles and which is displaceable by means of a linear displacement means 12, 13 into an x-direction and an y-direction. FIG. 1 also shows slide rods 14 on which a movable or displaceable member 16 of the injection mould and a fixed member 17 of the injection mould are guided. An injection duct 18 is provided at the fixed member 17 of the injection mould. The displaceable member 16 is displaceable through a thrust member 20 into the arrow directions A (open) and Z (close).

For moulding an injection moulded part, the displaceable member 16 and the fixed member 17 are joined, wherein the spray head 10 is withdrawn. Material is injected through the injection duct 18, and after hardening of the material, the displaceable member 16 is withdrawn by the thrust member 20 in the direction of arrow A in order to open the injection mould. The injection-moulded product (not shown) falls out and the spray head 10 is moved by means of the linear displacement means 12 and 13 between the opened mould halves 16 and 17 in order to spray the powdery parting agent onto members 16 and 17.

As described above, the powder feed must be controlled with regard to the entirely discharged powder quantity as well as with regard to the turn-on and turn-off behavior in order to spray the required powder quantity in a gush-free manner. For this purpose the control system shown in FIG. 2 may be used.

Figure 2:
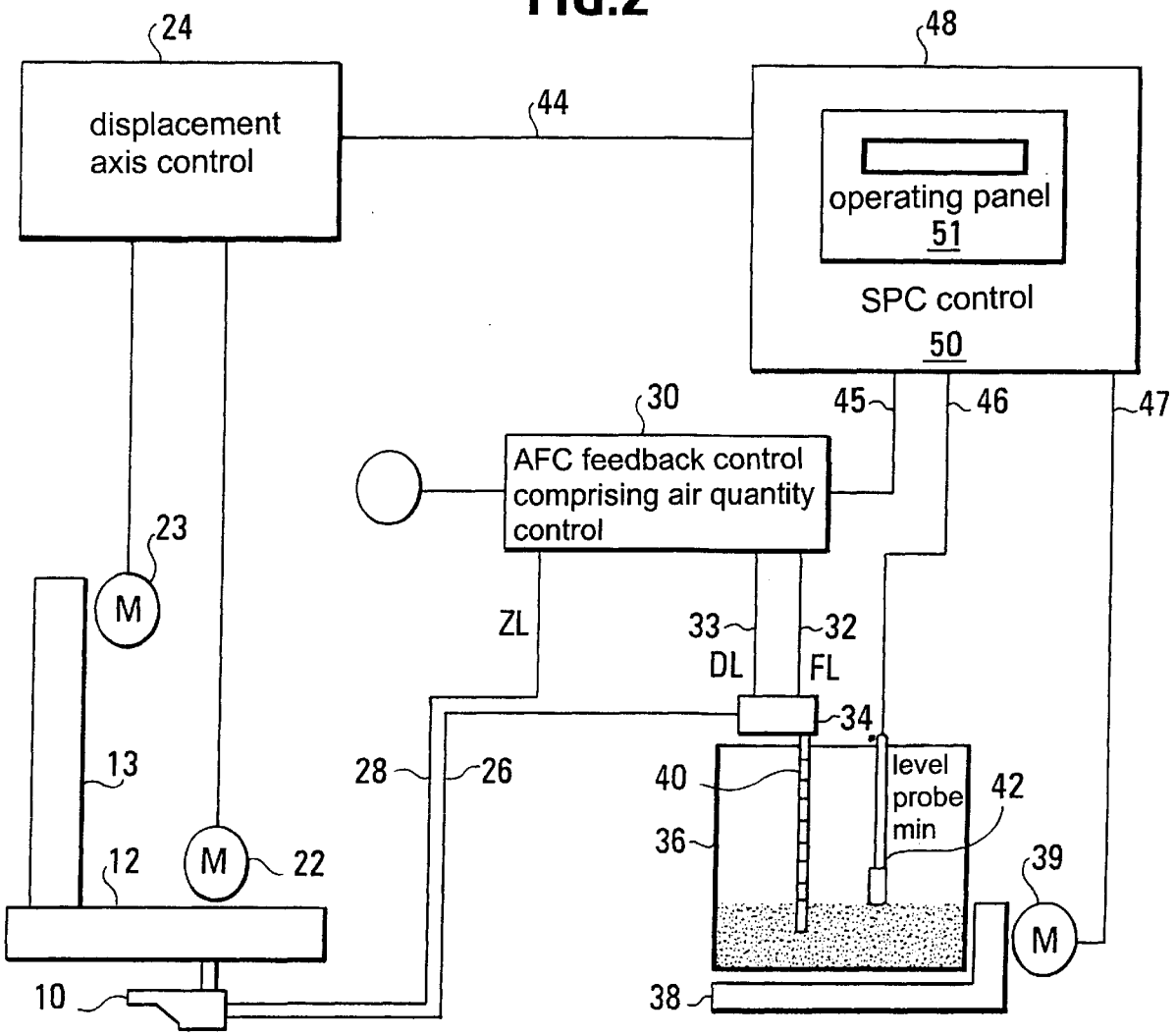
FIG. 2 is a schematical circuit diagram of a device for applying a powdery parting agent according to the invention.

FIG. 2 shows the spray head 10 in the form of one single spray gun, which is movable in the x- and y-directions (see FIG. 1) by means of the linear displacement means 12, 13.

The linear displacement means 12, 13 comprises an x-axis motor 22 and an y-axis motor 23, which are both controllable through a displacement axis control 24. A powder line 26 and an atomization air line 28 lead to the spray gun 10. The atomization air line 28 is connected to an air quantity control unit 30. A feed air line 32 and a dosing air line 33 lead from the air quantity control unit 30 to a feed means 34, for instance to a Venturi injector having a dosing air intake.

A control means suitable for the invention is for instance disclosed in the U.S. Pat. No. 6,029,527 (based on German patent application No. 197 13 668). A device for measuring a powder mass flow in a feed line is disclosed in the U.S. Pat. No. 5,864,239 (based on German patent application No. 196 50 112), said device being suitable for deriving the actual values suitable for the control process. An injector suitable for realizing the invention is disclosed in the U.S. Pat. No. 6,051,280 (based on German patent application No.197 38 144). It is referred to these references as far as they are relevant for carrying out the method according to the invention.

A vessel for a powdery parting agent 36 is installed on a vibratory plate 38 which has a vibratory motor 39. Instead of or in addition to the vibratory plate 38, a fluidization bottom (not shown) may also be provided for the powdery parting agent in order to swirl or fluidize the powdery parting agent in the vessel 36. An intake tube 40 leads from the interior of the vessel to the feed device 34. Furthermore, a level probe 42 is provided in the vessel 36 in order to monitor the powder level in the vessel 36.

Signal lines 44, 45, 46 and 47 lead from the displacement axis control 24, the air quantity control unit 30, the level probe 42 and the vibratory motor 39 to a central control means 48, which in the embodiment shown comprises an SPC (Storage Program Control) 50 and an operating panel 51.

The device according to the invention operates as follows. After opening an injection mould and after the injection moulded product has fallen out, the spray gun 10 is moved between the opened injection mould halves 16, 17. In accordance with the respective injection mould and different apparatus parameters, turn-on and turn-off profiles are predetermined by the SPC control 50 for the powder supply. In accordance with these turn-on and turn-off profiles, the feed air, the dosing air and the atomization air are turned on, increased, reduced or turned off. It is ensured that the application of the powdery parting agent onto the injection mould halves is performed in a gush-free manner in order to precisely monitor and dose the parting agent quantity applied and in order to avoid uncontrolled powder clouds or blows. When for instance turning on the powder supply at the beginning of a spray shot, the dosing and feed air is not increased abruptly but gradually. When turning off the powder supply the feed air for instance is slowly reduced and the dosing air is increased to a maximum before it is also turned off. The person skilled in the art may find suitable turn-on and turn-off profiles by making tests for the respective coating surroundings.

A further feature of the invention is that when applying the powdery parting agent, considerably lower powder quantities must be applied compared to the coating processes in today's common powder coating apparatus. The quantity of the parting agent to be applied is according to the latest experiences, a maximum of 50 g/min, wherein the powder flow should be accurately doseable in the range of 0 to 50 g/min. When automated apparatus are used, the powder quantity actually transported via the powder line 26 to the spray gun 10 should be measured and controlled.

The control may for instance be carried out according to the U.S. Pat. No. 6,029,527 (based on German patent application No. 197 13 668). An especially favorable measuring means for the powder mass flow is disclosed in the U.S. Pat. No. 5,864,239 (based on German patent application No. 196 50 112). The disclosure of these documents is incorporated in this specification by reference.

In the U.S. Pat. No. 6,029,527 a method and an apparatus for measuring and controlling the flow of a fluid is disclosed in which the signals from the flow measurement are processed substantially digitally and are supplied to a digital signal processor. The signal processor controls a digital control unit in accordance with the measuring magnitudes, preferably by the aid of information from special memory units, such as turn-on and turn-off profiles, said control in turn controls through actuator members for instance the feed air, the dosing air and the atomization air. The control unit preferably includes a PID controller. The actuator member preferably includes a pulse width modulator. The valve means preferably includes a proportional valve.

The apparatus for measuring a powder mass flow disclosed in the U.S. Pat. No. 5,864,239 comprises a speed measuring device for measuring the speed of the powder-gas mixture in the feed line, a mass measuring device for measuring the powder mass per volume unit in a section of the feed line which comprises a microwave resonator as well as means for detecting a change of the resonance frequency and/or the microwave amplitude of the microwave resonator and which derives the powder mass in the feed line section from the detected resonance frequency and/or the microwave amplitude, and which comprises a calculation device for calculating the powder mass flow from the measured speed, the measured powder mass per volume unit and the dimensions of the feed line. The microwave resonator preferably comprises a coil which is attached to the outer side of the feed line.

The device according to the invention for applying the powdery parting agent is shown in FIG. 2 having an SPC control. As an alternative, it may also be controlled decentrally and may be designed in accordance with the guidelines disclosed in the U.S. Pat. No. 6,059,884 (based on German patent application No. 197 38 141) for a control system of a coating apparatus. It is referred to this document.

The features disclosed in the above description, in the claims and in the drawing may be meaningful for realizing the invention in its different embodiments either individually or in any combination.

We claim:

1. A method of applying a parting agent to a surface of a heated mould, comprising:

spraying a powdery parting agent via pressurized air onto the hot surface of the mould in a substantially uniform manner immediately after ejection of a moulded product; and reflowing the sprayed powdery parting agent on said surface of the mould when impinging thereon to form a film of parting agent on the surface;

wherein the pressurized air contains a feed air portion and a dosing air portion, and at the beginning and the end of a spraying event, the feed air portion and the dosing are portion are varied in accordance with predetermined control profiles in order to spray the required quantity of powdery parting agent in a gush-free manner.

2. A method as claimed in claim 1, characterized in that the feed air portion and the dosing air portion are controlled separately in accordance with the actually applied quantity of the powdery parting agent.

3. A method as claimed in claim 1, characterized in that at the end of a spray event, the feed air portion is reduced and the dosing air portion is increased in order to blow empty a feed line (26) for the parting agent in a gush-free manner.

4. A method as claimed in claim 3, characterized in that at the end of the spray event the feed air portion is turned off and the dosing air portion is temporarily increased to a maximum.

5. A method as claimed in claim 1, characterized in that the feed air and the dosing air are gradually increased at the end of a spray event.

6. A method as claimed in claim 1, characterized in that the powdery parting agent is sprayed in a controlled manner at a quantity of 0 to approximately 50 g/min.

7. The method of claim 1 performed using a powder spray device (10) with a feed line (26) for powdery parting agent which is connected to the powder spray device from a feed device (34), the method further comprising: feeding the powdery parting agent through the feed line to the powder spray device via pressurized air, and controlling the air quantity for adjusting the pressurized air and therefore the fed quantity of the powdery parting agent.

8. The method of claim 7 wherein a feed air line and a dosing air line are connected to the feed device and the air quantity in the feed air line and in the dosing air line are altered to adjust the feed air quantity and the dosing air quantity.

9. The method of claim 8 including a memory and comprises storing control profiles in the memory for the increase and reduction of at least one of the feed air quantity and the dosing air quantity.

10. The method of claim 10 including a measuring means and comprising detecting by the measuring means the mass flow of the powdery parting agent to be transported through the feed line (26).

11. The method of claim 7 including activating an atomization line (28) which is connected to the spray device (10) and the air quantity control device (30) for controlling the quantity of powdery parting agent from the powder spray device.

12. The method of claim 7, characterized by displacing the powder spray device (10) in two orthogonal directions to move the powder spray device between two halves of an opened mould (16, 18).

13. The method of claim 7, characterized in that the powdery parting agent is supplied to the powder spray device through the feed line (26) which has an inner diameter of 10 mm maximum.

14. The method of claim 8, characterized in that the feed air quantity and the dosing air quantity are adjusted to achieve a powder mass flow of the parting agent of 0 to approximately 50 g/min.

15. The method of claim 1 in which the parting agent for a mould includes a powder which abruptly reflows to form a film when impinging on the hot surface of the mould.

* * * * *

UNITED STATES PATENT AND TRADEMARK OFFICE

CERTIFICATE OF CORRECTION

PATENT NO. : 6,159,535
DATED : December 12, 2000
INVENTOR(S) : Lutz Bernd

It is certified that error appears in the above-identified patent and that said Letters Patent is hereby corrected as shown below:

Column 6,
Line 1, delete "are" and insert -- air --.
Line 41, delete "claim 10" and insert -- claim 1 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*